US006645058B2

(12) United States Patent
Puzio et al.

(10) Patent No.: US 6,645,058 B2
(45) Date of Patent: Nov. 11, 2003

(54) CLAMP MECHANISM FOR ROTARY TOOL DISC

(75) Inventors: Daniel Puzio, Baltimore, MD (US); Michael P. Baron, Phoenix, MD (US); Michael L. O'Banion, Westminster, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 09/996,665

(22) Filed: Nov. 29, 2001

(65) Prior Publication Data

US 2002/0119740 A1 Aug. 29, 2002

Related U.S. Application Data

(60) Provisional application No. 60/250,031, filed on Nov. 30, 2000.

(51) Int. Cl.[7] ..... B24B 41/06

(52) U.S. Cl. ..... 451/365; 451/509

(58) Field of Search ..... 451/350, 365, 451/342, 509, 398, 508, 510; 269/3, 6; 411/432, 433

(56) References Cited

U.S. PATENT DOCUMENTS

| | | | | |
|---|---|---|---|---|
| 4,134,438 A | | 1/1979 | Frieberg et al. | |
| 4,525,097 A | | 6/1985 | Ziegelmeyer | |
| 4,941,790 A | | 7/1990 | Kirn | |
| 4,955,744 A | | 9/1990 | Barth et al. | |
| 4,980,994 A | | 1/1991 | Helm et al. | |
| 5,022,188 A | | 6/1991 | Borst | |
| 5,042,207 A | | 8/1991 | Kirn | |
| 5,161,334 A | | 11/1992 | Schaal et al. | |
| 5,175,963 A | | 1/1993 | Schä fer et al. | |
| 5,177,905 A | | 1/1993 | Takahashi et al. | |
| 5,259,145 A | | 11/1993 | Fushiya et al. | |
| 5,388,942 A | | 2/1995 | Bonacina et al. | |
| 5,567,100 A | | 10/1996 | Nakamura | |
| 5,577,872 A | | 11/1996 | Nakamura | |
| 5,619,770 A | * | 4/1997 | Bell | 15/230.17 |
| 5,707,275 A | | 1/1998 | Preis et al. | |
| 5,810,533 A | | 9/1998 | Nakamura | |
| 5,871,322 A | | 2/1999 | Nakamura | |
| 5,899,648 A | | 5/1999 | Kanaan et al. | |
| 5,947,671 A | * | 9/1999 | Kanaan et al. | 411/435 |
| 6,050,741 A | | 4/2000 | Aultman et al. | |
| 6,116,996 A | * | 9/2000 | Yanase | 451/359 |
| 6,148,526 A | | 11/2000 | Kirn et al. | |
| 6,149,364 A | | 11/2000 | Maeda | |
| 6,273,659 B1 | | 8/2001 | Goto | |

* cited by examiner

*Primary Examiner*—Dung Van Nguyen
(74) *Attorney, Agent, or Firm*—Michael P. Leary; Charles E. Yocum; John D. DelPonti

(57) ABSTRACT

A clamping assembly adjustable from a first position with a first stack height to a second position with a second stack height less than the first stack height, whereby said clamping force is substantially released, said clamping assembly comprising: a flange nut; a clamp flange connected to the flange nut; a thrust plate having a plurality of axial penetrations and rotatably mounted between the flange nut and clamp flange; a first roller cage having a plurality of penetrations; a first plurality of rolling elements rotatably mounted in the penetrations of the first roller cage; a second roller cage having a plurality of penetrations; a second plurality of rolling elements rotatably mounted in the penetrations of the second roller cage; a ring collar having rotatably mounted between the clamp flange and the flange nut and surrounding and rotationally engageable to the thrust plate, whereby rotation of the ring collar rotates the thrust plate relative to the first and second roller cages from the first position with the first stack height, wherein the first and second roller elements contact the axial surface of the center thrust plate, to the second position, wherein the first and second rolling elements have entered the axial penetrations in the thrust plate and thus establish the second stack height.

2 Claims, 8 Drawing Sheets

CLAMP MECHANISM FOR ROTARY TOOL DISC

This application claims the benefit of provisional application No. 60/250,031 filed Nov. 30, 2000.

BACKGROUND OF THE INVENTION

1. Field of the Invention

The present invention relates generally to the field of rotary power tools. In particular the present invention relates to a tool-free mechanism for clamping interchangeable rotary tool accessories, such as grinding discs, circular saw blades, etc.

2. Discussion

Various types of rotary power tools require a user to selectively attach a tool accessory, such as a grinding disc. Over the course of a particular project or work period it may be necessary to employ a variety of such accessories and to replace worn or broken ones. Convenient removal and replacement of the interchangeable tool accessories is therefore desirable.

Various methods are employed for clamping such accessory discs. For example, in current grinder designs a replaceable grinding disc has a center hole. The hole in the grinding disc fits over the end of the grinder's output shaft or drive spindle, with the plane of the grinding disc transverse to the axis of the shaft. For some radial distance the interior surface of the disc hub rests against a flat shoulder of the shaft or an inner washer connected to the shaft.

Conventionally, the grinding disc is clamped in place against the shoulder or inner washer with a retaining-nut threaded down over a threaded end of the drive spindle. An outer washer may be placed between the nut and the hub of the grinding disc. When changing grinding discs, the nut must be loosened and removed. The tightening and loosening of the nut may be partially performed by hand, but the size and shape of the nut make it difficult and/or uncomfortable to properly tighten and then initially loosen using hands alone. Therefore, it is necessary to use a hand wrench or similar tool in order to apply sufficient torque to the retaining nut.

Additionally, when tightening or loosening the nut, the shaft/spindle must be prevented from rotating or else it would be difficult to achieve relative motion between the nut and the rotatable spindle. Conventionally, the loosening and tightening process requires that the operator simultaneously grip both the shaft/spindle and the nut with two separate hand wrenches or the like. Then a torque is applied to the nut while the shaft is held in place. This is an awkward process and made even more so by the necessity to support the weight of the tool itself.

More recently, tools have been designed that incorporate a locking mechanism that locks the shaft/spindle relative to the tool housing. Thus, the rotation of the shaft can be prevented, simply by employing the built in shaft lock. For such a power tool, only one hand wrench is required to loosen or tighten the nut.

The need to use even one hand tool to change grinding discs, however, is still inconvenient. For example, when a replacement disc is required, the tool operator has to stop what he is doing to find a wrench, which may not be readily at hand.

To make the replacement of a grinding disc a tool free process, a number of clamping devices that can be tightened and loosened by hand have been invented. Such prior art devices have had several drawbacks including: the clamping device height interferes with use of the grinding tool; the clamping device does not self tighten during operation or, if it does self tighten, it cannot be readily released by hand; and incorporation of a slip clutch effect to prevent over-tightening.

An example of such a quick acting clamping device is described in U.S. Pat. No. 5,707,275 to Preis et al., which is embodied in the FIXTEC® Rapid Locking Nut manufactured by INA Wälzlager Schaeffler oHG. The clamping device according to the U.S. Pat. No. 5,707,275, patent has a slip clutch function that, while preventing over tightening of the clamping device, unnecessarily limits the usable torque of the grinding machine.

SUMMARY OF THE INVENTION

It is, therefore, one object of the invention to provide an improved device for simple and reliable axial clamping of a tool accessory disc, such as a circular grinding disc, without the use of any hand tools. Further objectives of the present invention include:

A compact, low height design;

Simply shaped and easy to manufacture parts;

Low manufacturing cost;

Provides for self-tightening under load, but without loss of the ability to loosen by hand.

These and other objects of the invention are accomplished according to the present invention in a clamping device constructed of stacked components that can be manipulated from a first position having a first stack height to a second position having a second stack height less than the first stack height. The clamping assembly is installed and tightened in the first position with the greater stack height. After tightening, the axial reaction load on the camping assembly would require significant torque to unscrew. By first manipulating the assembly into the second position and consequently reducing the stack height of the assembly, however, the axial reaction load is significantly reduced. Thus, the torque required to unscrew the device is reduced to levels that can be applied by hand.

In order to so function, the clamping assembly includes a clamp flange positioned axially inward against the hub of the grinding disc. Stacked axially outward of the clamp flange is a first roller cage. The roller cage is pierced by a plurality of angularly spaced perforations. Rotatably mounted in the perforations is a first set of rolling elements. The rolling elements may be needle bearings, which distribute the axial load and minimize the overall stack height of the clamping assembly, but may include other types of bearings. Stacked axially outward of the first roller cage is a center thrust plate, also pierced by a plurality of angularly spaced perforations, equivalent in number to the rolling elements. Equivalently, instead of perforations, appropriately sized and spaced indentations could be located on the opposed sides of the center thrust plate.

Stacked axially outward of the center thrust plate is a second roller cage pierced by a plurality of angularly spaced perforations. Located in the perforations of the second roller cage is a second set of rolling elements. The first and second roller cages are connected so as to rotate together with the two sets of rolling elements in axial alignment. Said connection may be by means of a tab and slot combination on the outer circumference of the roller cages.

The center thrust plate is sandwiched in between the roller cages and can rotate relative thereto. A biasing means, rotationally biases the center thrust plate into a ready or locked position, relative to the roller cages, wherein the two sets of rolling elements rest on the opposite flat surfaces of the center thrust plate, rather than in the perforations of the center thrust plate. The biasing means may include springs.

Stacked axially outward of the second roller cage is a flange nut with an axially projecting hub. The hub threadably engages the shaft of the grinding tool. The clamp flange is rotationally locked with the flange nut, but they have limited axial movement between them. The rotational engagement of the clamp flange and the flange nut may be accomplished by use of mating double—D surfaces near the radially inner perimeters of the two elements.

Sandwiched rotatably between the clamp flange and the flange nut is a ring collar, which surrounds the stacked center thrust plate and roller cages. The outer circumference of the ring collar has a grippable surface. Within the inner circumference of the ring collar, the interlocked roller cages can rotate. The center thrust plate is connected to the ring collar, so that the thrust plate will turn when the surrounding ring collar is turned. Said connection can be accomplished by means of a tab and slot combination between the inner circumference of the ring collar and the outer circumference of the center thrust plate.

In its ready or locked position the springs have rotationally biased the center thrust plate so that the rolling elements, while inside their respective perforations in the roller cages, are outside the perforations in the center thrust plate and contacting the flat surfaces thereof. Thus, the sub-assembly of the roller cages, rolling elements and center thrust plate will have a first stack height when in said ready or locked position. Accordingly, the entire clamping assembly will have a ready or locked height.

To install the clamping assembly onto a grinder shaft, the user grasps the ring collar and turns it clockwise so as to thread the assembly onto the shaft. The turning of the ring collar is transmitted to the center thrust plate. The rotation of the center thrust plate is transmitted to the flange nut by a torque transmission means. The rotation of the flange nut will cause its threads to move axially down the threaded grinder shaft.

Said torque transmission means allows for some limited rotational movement between the center thrust plate and the flange nut. The torque transmission means may include a bump on the inner perimeter of the center thrust plate that can engage a flat surface on the hub of the flange nut. When tightening in the clockwise direction the bump contacts the flat surface at a first point, but when switched to loosening in the counter-clockwise direction the center thrust plate must rotate relative to the flange nut until the bump engages the flat surface at a second point.

Alternatively the torque transmission means may be in the form of a leaf spring on the inner perimeter of the center thrust plate. When tightening, the inner perimeter of the center thrust plate engages the hub and drives the rotation of the flange nut. When loosening in the counterclockwise direction, however, the leaf spring contacts the hub of the center thrust plate and, by compressing, allows a limited amount of rotation by the center thrust plate relative to the flange nut.

As the clamping assembly threads down on the shaft, the clamp flange will contact the hub of the grinding disc. Further tightening of the assembly will exert a clamping force onto the grinding disc and a corresponding axial reaction force will be transmitted into the clamp flange. The axial reaction force will be transmitted from the clamp flange via the first set of rolling elements, then the center thrust plate, then the second set of roller elements and finally into the flange nut. The flange nut will transmit the axial reaction force into the grinder shaft via its threads.

Although initially only hand tight, operation of the grinder will cause the clamping assembly to self-tighten. During operation, slippage induced rotation of the grinding disc will be transmitted to the clamp flange by friction. The rotation thus imparted to the clamp flange will be transmitted to flange nut and will cause the threads to run down on the grinder shaft, thus increasing the clamping force exerted by the clamping assembly until the slippage of the grinding disc stops.

To loosen the clamping assembly, the user grasps the ring collar and turns counter clockwise. Turning the ring collar integrally turns the center thrust plate. Due to the torque transmission means, as described above, there is some lost rotational motion between the center thrust plate and the flange nut. Initially, therefore, the center thrust plate and connected ring collar can turn without applying the torque that would otherwise be necessary to overcome the axial reaction force on the flange nut.

During that limited range of rotation, the center thrust plate rotates relative to the roller cages. The first set of rolling elements roll between the center thrust plate and the clamp flange and the second set of rolling elements roll between the center thrust plate and the flange nut. Although under compression, the rolling elements roll along the flat surfaces of the center thrust plate until they roll into the perforations therein.

With the rolling elements in the perforations of the center thrust plate, rather than on the flat surfaces thereof, the clamping assembly is in the unlocked position. In the unlocked position the sub-assembly of roller cages, rolling elements and center thrust plate have a second stack height. The stack height of the unlocked position is less than the stack height of the ready or locked position, described above. The thickness of the center thrust plate is such that, with the rolling elements in the perforations of the center thrust plate, rather than on the flat surfaces, the clamping force exerted by the clamp flange is substantially reduced. With the axial reaction force on the clamping assembly correspondingly reduced, the transmission means can now engage the flange nut and readily unthreaded it by hand.

During the loosening operation, the relative rotational movement between center thrust plate and interlocked roller cages causes the compression of the springs. When the flange nut is backed off and the axial reaction force between the elements of the clamping assembly is released, the spring will cause the center thrust plate to rotate relative to the roller cages. The roller elements ride up out of the perforations in the center thrust plate and return to the previously described ready position on the flat surfaces of the center thrust plate. In such ready position, the clamping assembly is ready for reinstallation and tightening In a particular embodiment, the flat surface of the center thrust plate may include a chamfer on the edge of its perforations. During loosening, the chamfer reduces the rolling friction experienced by the roller elements as they roll across the flat surfaces toward the perforations. This reduction in rolling friction will reduce the initial unlocking torque that the operator must manually apply to the ring collar during loosening, thus making the clamping assembly easier to unlock. The exact shape and dimensions of the chamfer, as well as the number of perforations that have a chamfer, can be selected to achieve the unlocking torque desired by the designer.

BRIEF DESCRIPTION OF THE DRAWINGS

Additional objects and advantages of the present invention will become apparent from a reading of the following detailed description of the preferred embodiments that make reference to the drawings of which.

DETAILED DESCRIPTION

The present invention provides a manual clamping assembly for rotary power tools employing rotating accessories such as grinding discs and circular saw blades. While shown through the drawings in various embodiments of a clamping assembly for a portable grinder, those skilled in the art will appreciate that the invention is not so limited in scope. In this regard, the teachings of the present invention will be understood to be readily adaptable for use in any tool presently incorporating a threaded bolt or nut and washer clamping arrangement for holding a rotating tool accessory (e.g. grinders, polishers, framing saws, circular saws, etc.). Furthermore, although described throughout as a disc or a blade, it is contemplated that the present invention is adaptable to any interchangeable tool accessory designed to rotate around a central hub.

Figure 1:
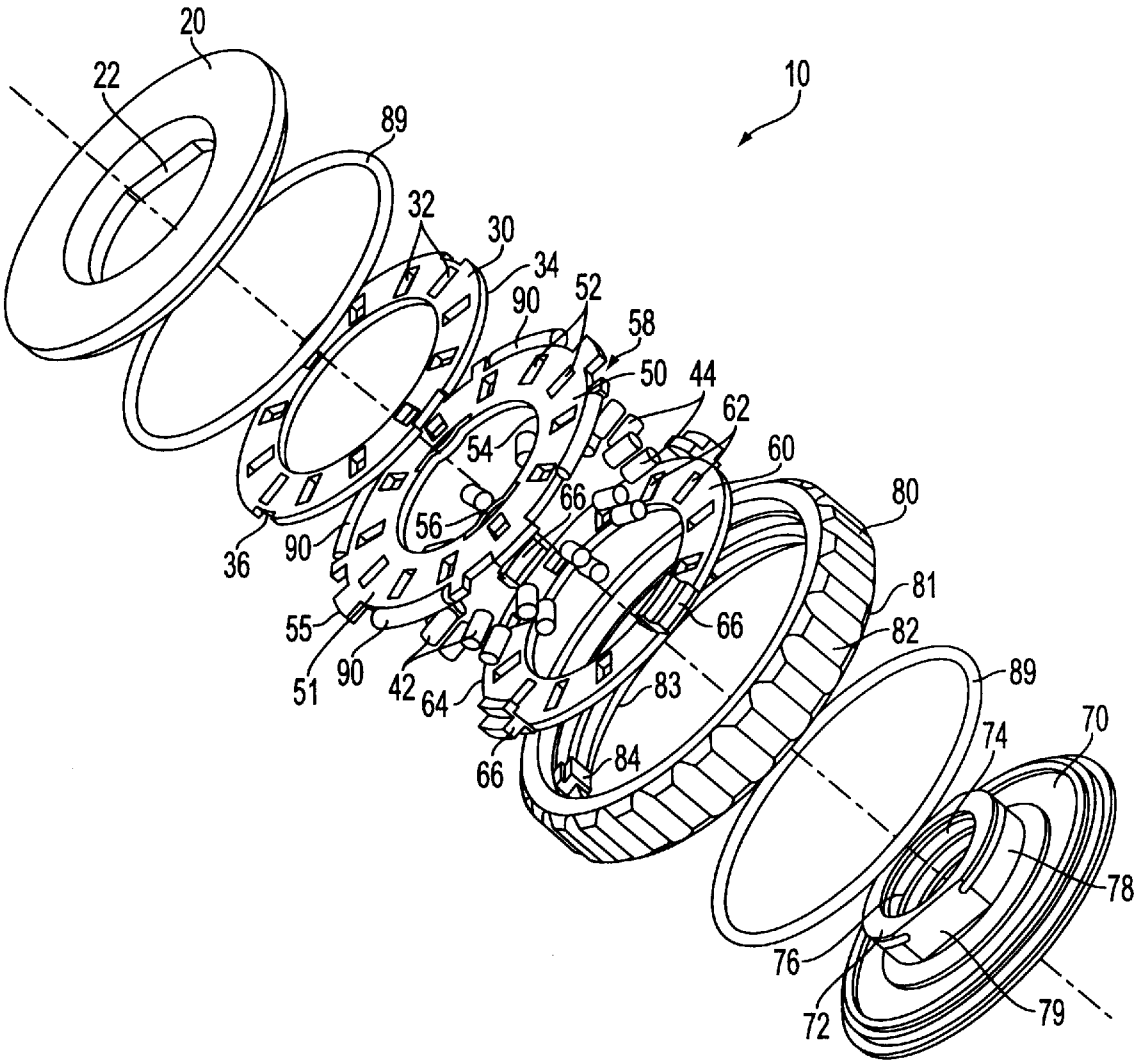
FIG. 1 is an exploded view of a clamping assembly according to the present invention.
Figure 2:
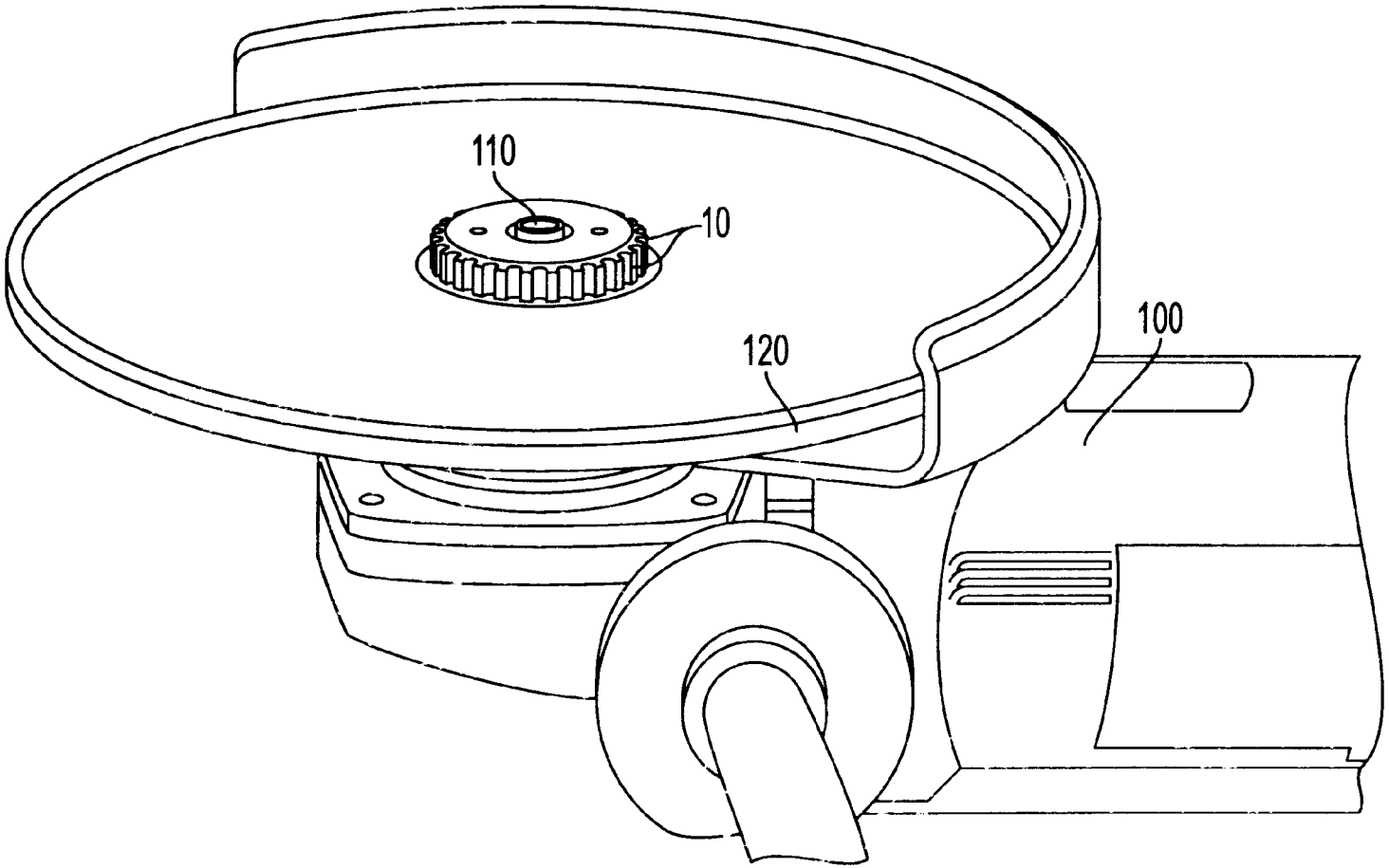
FIG. 2 is a perspective view of the clamping assembly of FIG. 1 installed on a representative grinding tool.

Turning generally to the drawings in which identical or equivalent elements have been denoted with like reference numerals, and particularly to FIGS. 1 and 2, a manual clamping assembly is illustrated and designated with the reference numeral 10. Clamping assembly 10 cooperates with a rotary power tool, designated generally with the reference numeral 100, to clamp and hold a disc shaped power tool accessory, here a grinding disc 120.

The particular clamp assembly shown is constructed of stacked components including a clamp flange 20 that is positioned axially inward against the axially outward hub of the grinding disc 120. Clamp flange 20 is in the form of an annular washer whose inner annulus 22 is of a double—D configuration.

Stacked axially outward of the clamp flange 20 is a first roller cage 30. Roller cage 30 is in the form of a thin annular washer. Roller cage 30 is pierced by a plurality of radially extending and angularly spaced rectangular perforations 32. Spaced angularly around the outer circumference 34 of the first roller cage 30 are four slots 36.

Located in the perforations 32, in a manner to permit rotation, is a first set of rolling elements 42. The rolling elements 42 may be needle bearings.

Stacked axially outward of the first roller cage 30 is a center thrust plate 50. Center thrust plate 50 is in the form of a flat annular washer that is pierced by a plurality of radially extending and angularly spaced rectangular perforations 52, equivalent in number to the rolling elements 42. Located near the inner circumference 54 of the center thrust plate 50 and approximately 180° apart are two radially inward projecting bumps 56. In the outer circumference 55 of the center thrust plate 50 is a slot 58.

Stacked axially outward of the center thrust plate is a second roller cage 60. Second roller cage 60 is in the form of a thin annular washer that is pierced by a plurality of radially extending and angularly spaced rectangular perforations 62. Spaced angularly around the outer circumference 64 of the second roller cage 60 are four tabs 66.

Located in the perforations 62, in a manner to permit rotation, is a second set of rolling elements 44. Tabs 66 engage the slots 36 in the first roller cage 30 to align and rotationally lock the two roller cages 30 and 60, so that the two sets of rolling elements 42 and 44 are in axial alignment. Center thrust plate 50 is sandwiched in between the roller cages 30 and 60 and can rotate relative thereto.

Springs 90 are connected between the outer circumference 55 of the center thrust plate 50 and the outer circumference 64 of the second roller cage 60. Springs 90 rotationally bias the center thrust plate 50 into the locked position, further discussed below, wherein the two sets of rolling elements 42 and 44 rest on the opposite flat surfaces 51 of the center thrust plate, rather than in the perforations 52.

Stacked axially outward of the second roller cage 60 is a flange nut 70 in the form of an annular washer with an axially inward projecting hub 72. The inner circumference 74 of the hub 72 has threads 76 to engage the threaded shaft 110 of the grinding tool 100. The outer circumference 78 of the hub 72 is in a double-D configuration, which engages with the double-D shaped inner annulus 22 of the clamp flange 20 to rotationally lock the flange nut 70 with the clamp flange 20. A retaining ring, not shown, can hold the flange nut 70 and clamp flange 20 together with limited axial movement between them.

Sandwiched rotatably between the clamp flange 20 and the flange nut 70 is a ring collar 80, which surrounds the stacked center thrust plate 50, roller cages 30 and 60, and rolling elements 42 and 44. The outer circumference 81 of the ring collar 80 has a grippable surface 82. Within the inner circumference 83 of the ring collar 80, the interlocked roller cages 30 and 60 can rotate. The center thrust plate 50 is connected to ring collar 80 by the engagement of tab 84 with slot 58, so that the thrust plate will turn when the surrounding ring collar is turned. The joint between the clamp flange and ring collar and the joint between the flange nut and ring collar may be sealed by o-rings 89.

Figure 4:
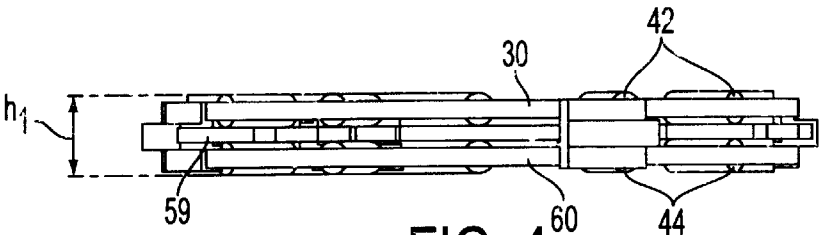
FIG. 4 is a side view of the FIG. 3 portion of the clamping assembly of FIG. 1.
Figure 3:
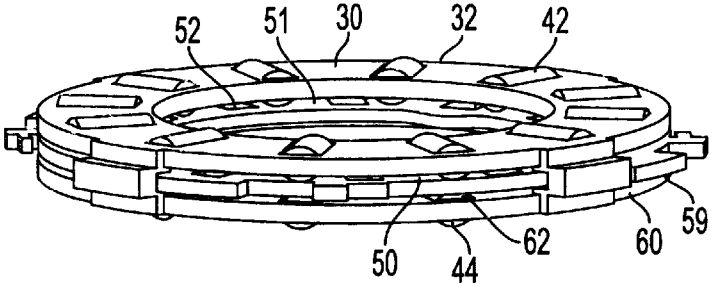
FIG. 3 is a perspective view of a portion of the clamping assembly of FIG. 1 in the locked position.

Understanding of the present invention will be improved by a description of its operation. At the start of installation, in the ready or locked position depicted in FIGS. 3 and 4, the springs 90 have rotationally biased the center thrust plate 50 so that the rolling elements 42 and 44, while inside their respective perforations 32 and 62 in the roller cages 30 and 60, are outside the perforations 52 and contacting the flat surfaces 51 of the center thrust plate 50. In said ready position the sub assembly of roller cages 30 and 60, rolling elements 42 and 44, and center thrust plate 50 have a first stack height $h_1$.

To install a clamping assembly 10 onto a grinder shaft 110, the user grasps the ring collar 80 and turns it clockwise so as to thread the assembly 10 onto the shaft 110. The turning of the ring collar 80 is transmitted to the center thrust plate 50 by tab 84 and slot 58. After some relative rotational movement, bumps 56 on center thrust plate 50 engage the flat surface 79 of the double—D configured outer circumference 78 of hub 72 of the flange nut 70, thus transmitting the rotation of the center thrust plate to the flange nut. The rotation of the flange nut 70 will cause threads 76 to move axially down the threaded grinder shaft 110 and will transmit the rotation to the clamp flange 20 via the interlocked double-D configured inner circumference 22.

As the clamping assembly 10 tightens down, the axially inward face of clamp flange 20 will contact the hub of the grinding disc 120. Further tightening of the assembly 10 will exert a clamping force onto the grinding disc 120. A corresponding axial reaction force will be transmitted into the clamp flange 20. The axial reaction force will be transmitted from the clamp flange 20 via the first set of rolling elements 42, then the center thrust plate 50, then the second set of roller elements 44 and finally into the flange nut 70. The flange nut 70 will transmit the axial reaction force into the grinder shaft 110 via threads 76.

Although initially only hand tight, operation of the grinder 100 will cause the clamping assembly 10 to self-tighten. During operation any slippage induced rotation of the grinding disc 120 will be transmitted to the clamp flange 20 by friction. The rotation thus imparted to the clamp flange 20 will be transmitted to flange nut 70 via the interlocked double—D elements at 22 and 79. The rotation imparted to flange nut 70 will cause threads 76 to tighten down on the grinder shaft 110, thus increasing the clamping force exerted by clamping assembly 10 until the slippage of the grinding disc 120 stops.

To loosen the clamping assembly 10, the user grasps ring collar 80 and turns counter clockwise. The turning of the ring collar 80 is transmitted via tab 84 and slot 58 and causes the center thrust plate 50 to turn relative to roller cages 30 and 60 and against the force of biasing spring 90. During this relative motion, the first set of rolling elements 42 roll between the center thrust plate 50 and the clamp flange 20 and the second set of rolling elements 44 roll between the center thrust plate 50 and the flange nut 70. The rolling elements 42 and 44 roll along the flat surfaces 51 of the center thrust plate 50 until they roll into the perforations 52.

Figure 6:
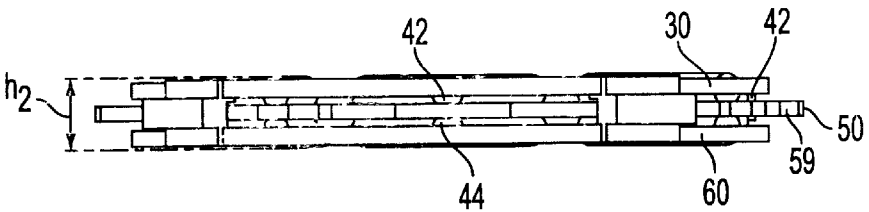
FIG. 6 is a side view of the FIG. 5 portion of the clamping assembly of FIG. 1.
Figure 5:
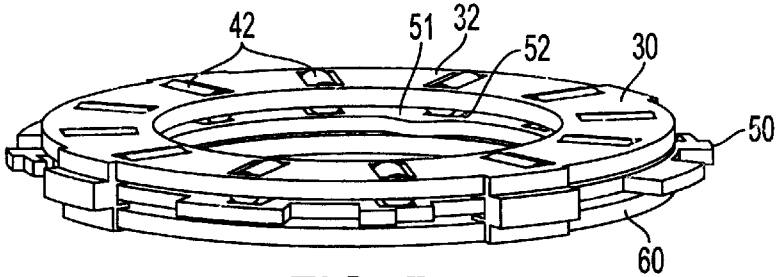
FIG. 5 is a perspective view of a portion of the clamping assembly of FIG. 1 in the unlocked or released position.
Figure 7:
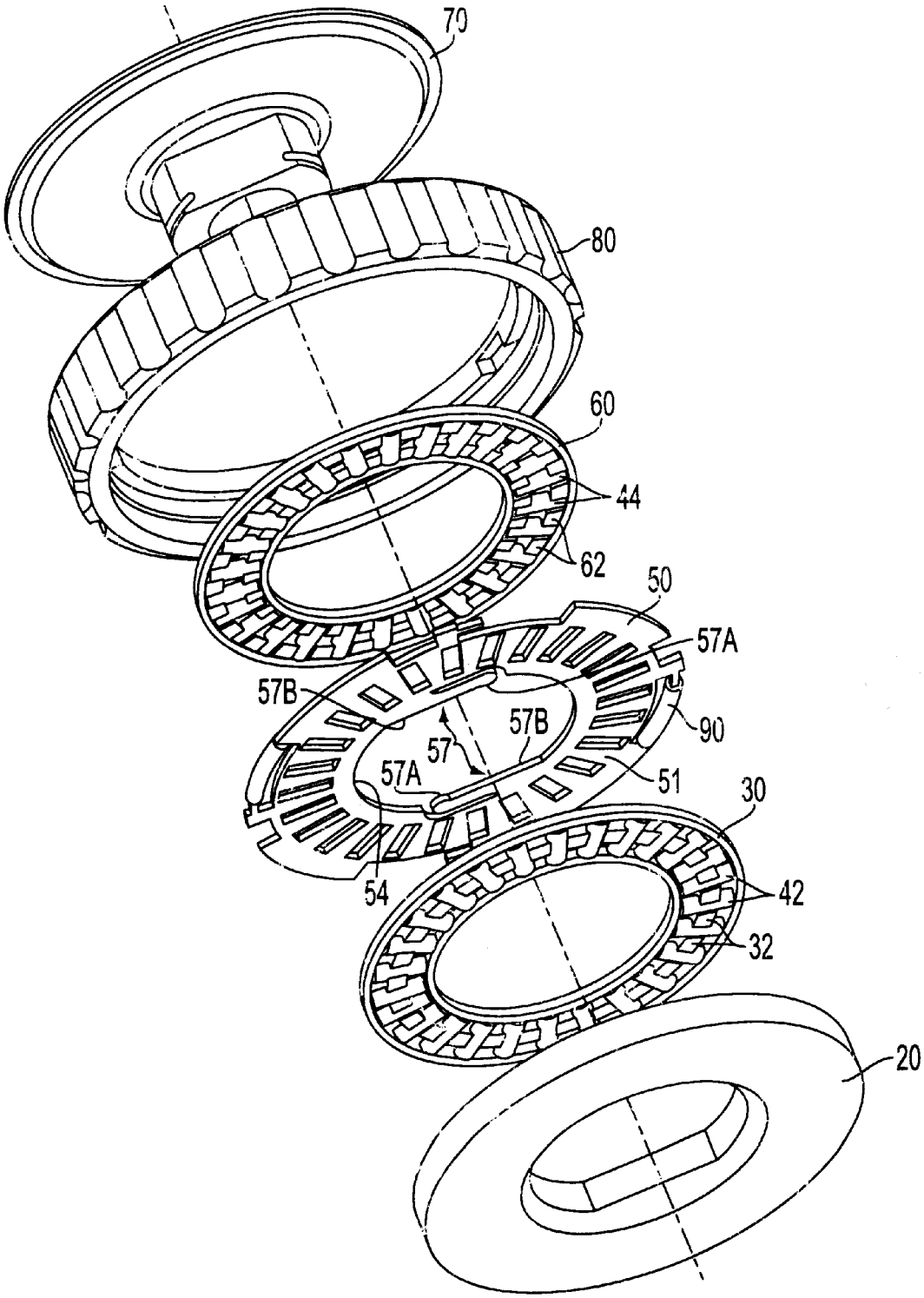
FIG. 7 is an exploded view of an alternative embodiment of a clamping assembly according to the present invention.
Figure 8:
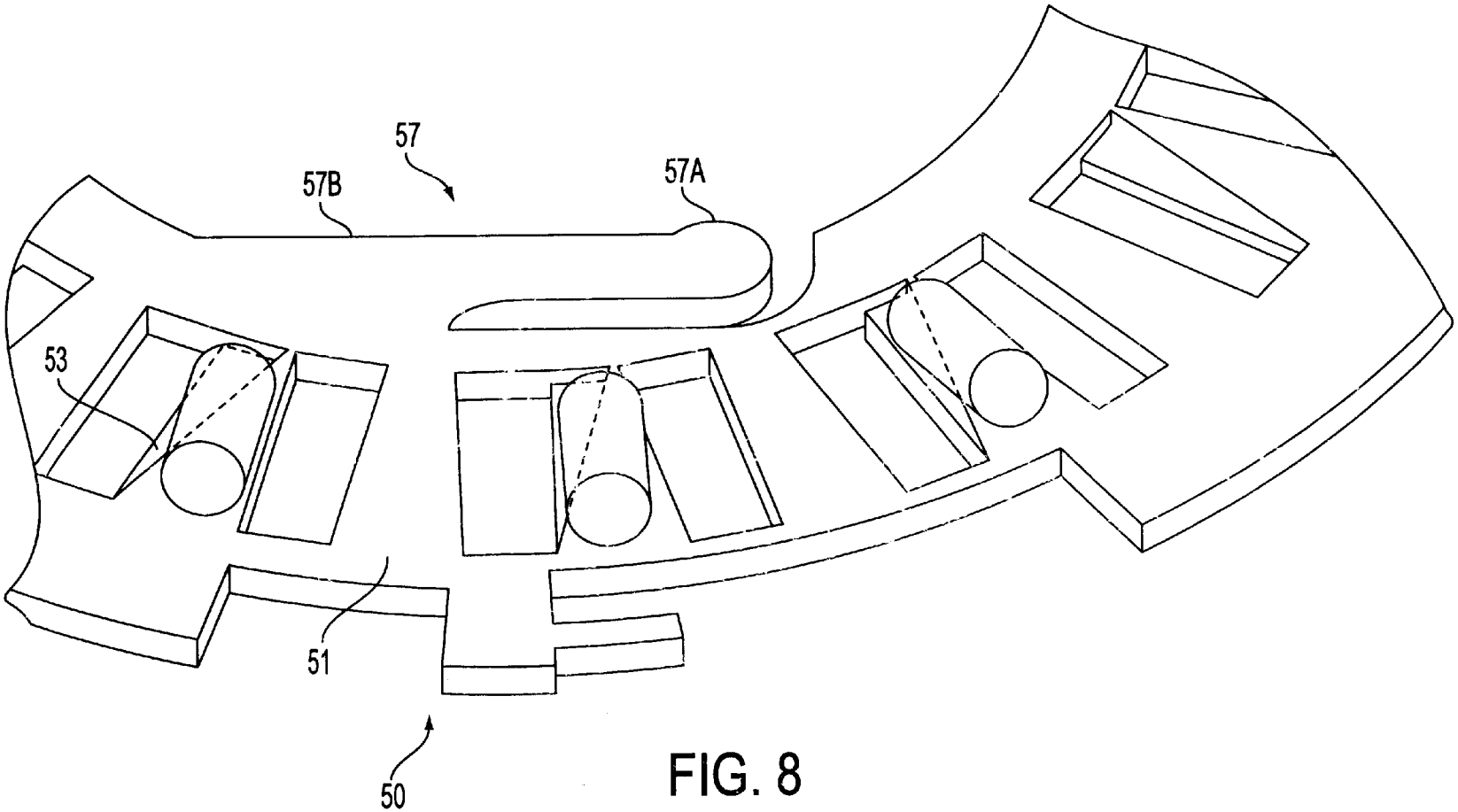
FIG. 8 is a close up perspective view of a portion the center thrust plate with phantom rolling elements according to the alternative embodiment of FIG. 7.
Figure 9:
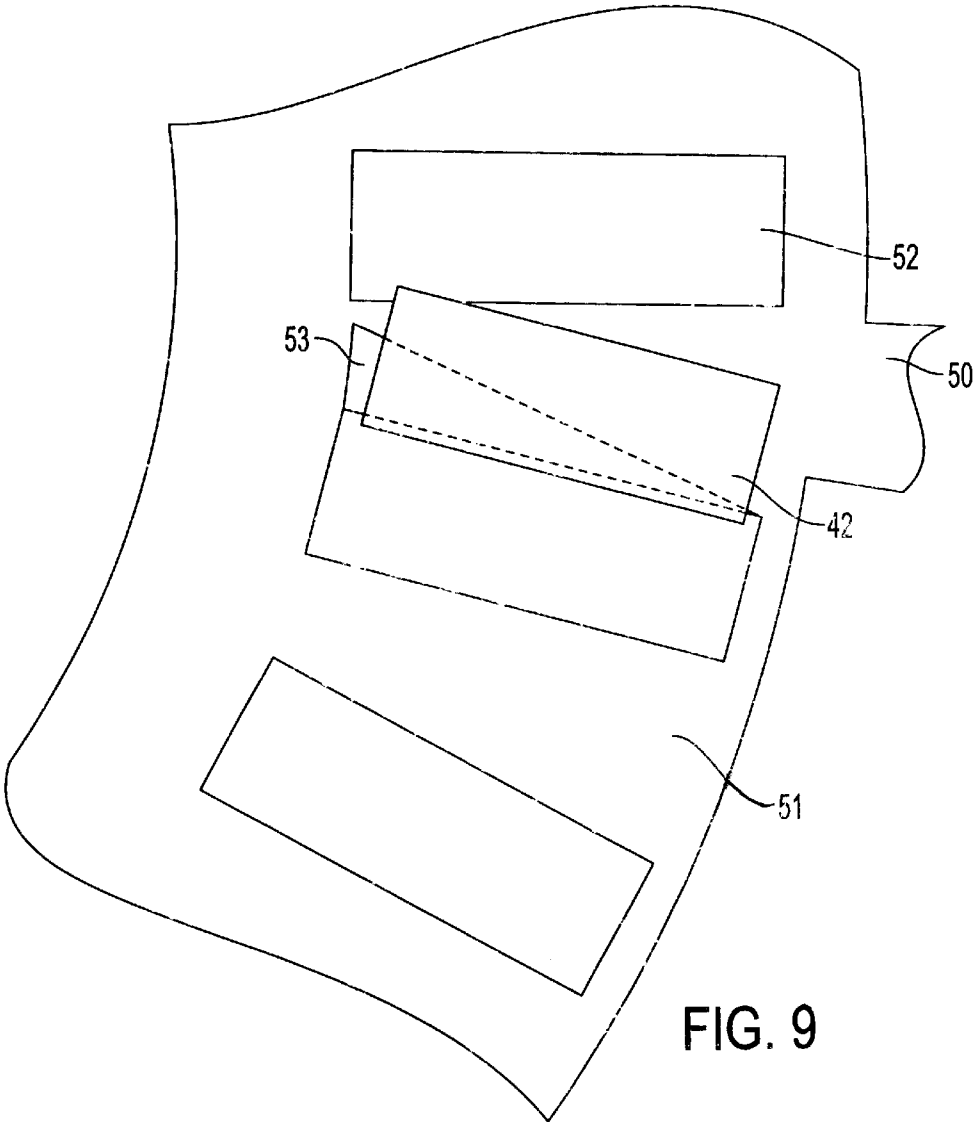
FIG. 9 is a close up overhead view of a portion of the center thrust plate and a locking element according to the alternative embodiment of FIG. 7.
Figure 10:
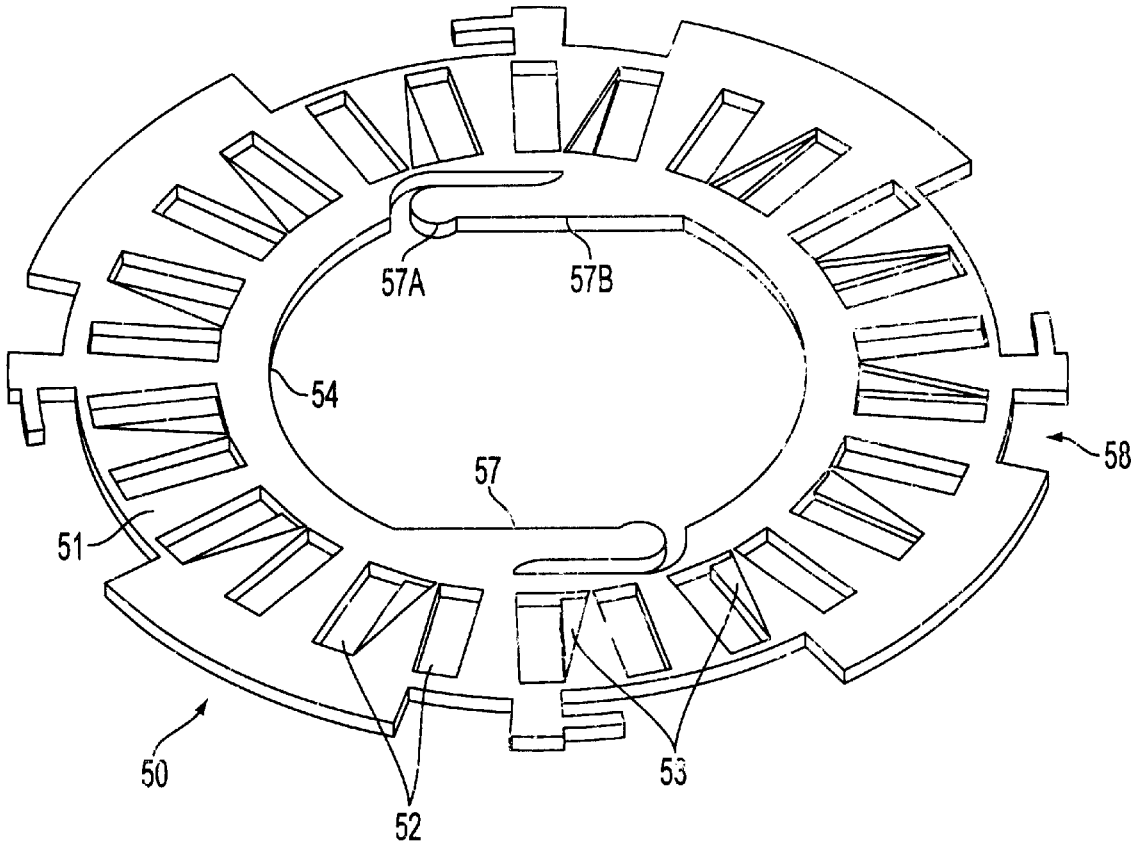
FIG. 10 is a perspective view of a center thrust plate of the alternative embodiment of FIG. 7.
Figure 11:
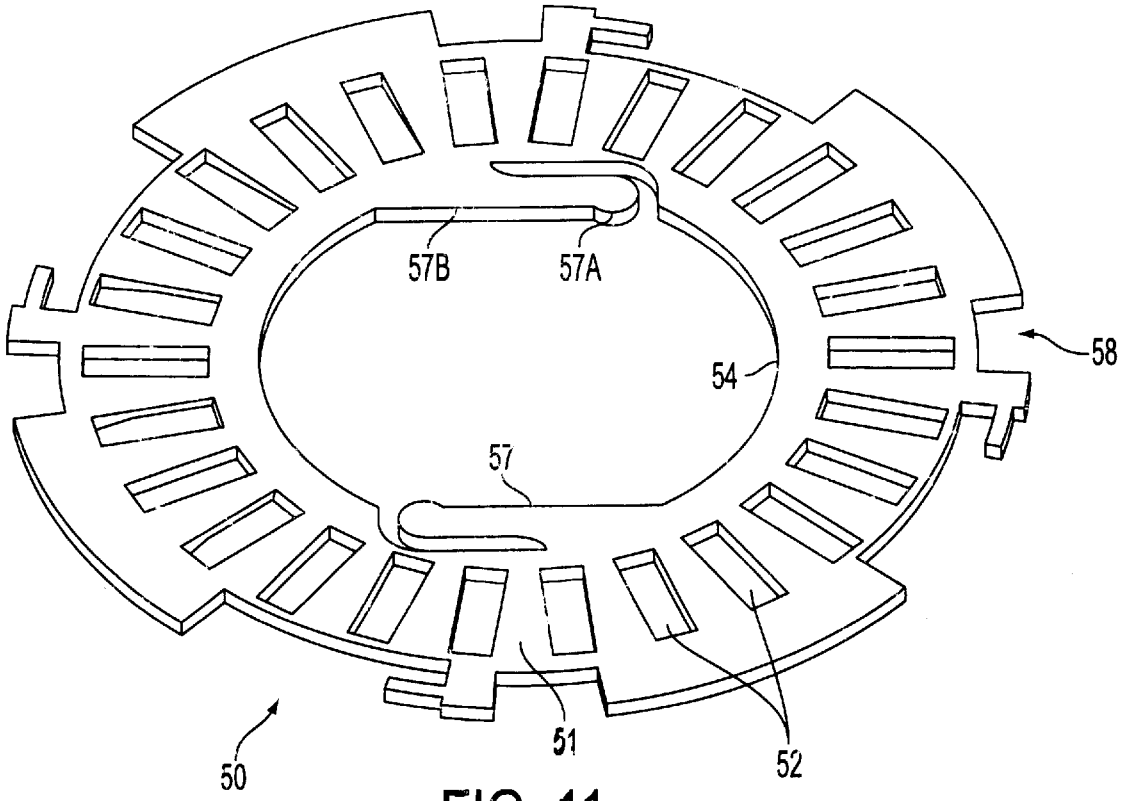
FIG. 11 is a perspective view of the reverse side of the center thrust plate of FIG. 10.

In this released or unlocked position, depicted in FIGS. 5 and 6, the sub assembly of roller cages 30 and 60, rolling elements 42 and 44, and center thrust plate 50 have a second stack height $h_2$, which is less than $h_1$. The thickness 59 of the center thrust plate 50 is such that, with the rolling elements 42 and 44 in the perforations 52, the clamping force exerted by clamp flange 20 is substantially reduced. With the axial reaction force on the clamping assembly 10 correspondingly reduced, it may be readily unthreaded by hand.

During the loosening operation, the relative rotational movement between center thrust plate 50 and interlocked roller cages 30 and 60 causes the compression of springs 90. When the flange nut 70 is backed off and the axial reaction force between the elements of clamping assembly 10 is released, the springs 90 will cause rolling elements 42 and 44 and roller cages 30 and 60 to rotate relative to the center thrust plate 50. The roller elements 42 and 44 ride up out of the perforations 52 and return to the previously described ready position on the surfaces 51 of the center thrust plate 50. In such ready position, the clamping assembly 10 is ready for reinstallation and tightening In a particular embodiment depicted in FIGS. 7 through 11, the surface 51 of center thrust plate 50 may be manufactured with a chamfer 53 on the edge of the perforations 52. During loosening, the chamfer 53 can reduce the rolling friction experienced by the roller elements 42 and 44 as they roll across surfaces 51 toward perforations 52. This reduction in rolling friction will reduce the unlocking torque that the operator must manually apply to the ring collar 80 during loosening, thus making the clamping assembly 10 easier to unlock. The exact shape and dimensions of the chamfer 53, as well as the number of perforations 52 that have a chamfer 53, can be selected to achieve the desired unlocking torque that the operator must exert by hand.

As also depicted in FIGS. 7 through 11, bumps 56 on the inner circumference 54 of center thrust plate 50 have been replaced by a leaf spring element 57. Leaf spring element 57 will rest flush against flat surface 79 on hub 72 of flange nut 70.

The cantilevered spring end portion 57A is oriented such that during installation and tightening, when ring collar 80 is turned clockwise, rigid portion 57B will transmit the rotation directly into flat surface 79. This arrangement eliminates the relative rotation, described above, between center thrust plate 50 and flange nut 70 to bring the bumps 56 into contact with flat surface 79.

During unlocking of the FIGS. 7–11 embodiment, the operator turns ring collar 80 counter-clockwise, which directly turns center thrust plate 50. Although the leaf spring element 57 is directly in contact with flat surface 79, spring end portion 57A deflects radially outward under the resistance of the flat surface 79 of flange nut 70, which is still under load. The deflection of spring end portion 57A permits sufficient relative movement of center thrust plate 50 to allow the rolling elements 42 and 44 to roll into the unlocked position in penetrations 52.

While the above description constitutes preferred embodiments of the invention, it will be appreciated that the invention is susceptible to modification, variation, and change without departing from the proper scope or fair meaning of the accompanying claims. In particular and as discussed above, the clamping assembly may be on any rotary power tool to clamp a disc type accessory to the rotary output shaft.

What is claimed is:

1. A clamping assembly for applying a clamping force to an accessory on the output shaft of a rotary tool and adjustable from a first position with a first stack height to a second position with a second stack height less than the first stack height, whereby said clamping force is substantially released, said clamping assembly comprising:

a flange nut threadably engageable with the output shaft;

a clamp flange operatively connected to the flange nut;

a thrust plate mounted between the flange nut and clamp flange and operatively engageable with one of the clamp flange and the flange nut and comprising an axial surface and defining a plurality of axial penetrations;

a roller cage defining a plurality of penetrations and rotatably mounted between the thrust plate and one of the clamp flange and the flange nut;

a plurality of rolling elements rotatably mounted in the penetrations of the roller cage; and a ring collar having rotatably mounted between the clamp flange and the flange nut and surrounding the thrust plate, roller cage and rolling elements, and rotationally connected to the thrust plate, whereby rotation of the ring collar rotates the thrust plate relative to the roller cage from the first position with the first stack height, wherein the roller elements contact the axial surface of the thrust plate, to the second position, wherein the rolling elements are located in the axial penetrations in the thrust plate and thus establish the second stack height.

2. A clamping assembly for applying a clamping force to an accessory on the output shaft of a rotary tool and said assembly adjustable from a first position with a first stack height to a second position with a second stack height less than the first stack height, whereby said clamping force is substantially released, said clamping assembly comprising:

a flange nut threadably engageable with the output shaft;

a clamp flange operatively connected to the flange nut;

a thrust plate mounted between the flange nut and clamp flange and operatively engageable with one of the clamp flange and the flange nut and comprising a first axial surface and a second axial surface and defining a plurality of axial penetrations;

a first roller cage defining a first plurality of penetrations and rotatably mounted between the thrust plate and the clamp flange;

a first plurality of rolling elements rotatably mounted in the penetrations of the first roller cage;

a second roller cage defining a second plurality of penetrations and rotatably mounted between the thrust plate and the flange nut;

a second plurality of rolling elements rotatably mounted in the penetrations of the second roller cage;

a ring collar rotatably mounted between the clamp flange and the flange nut and surrounding the thrust plate, the first and second roller cages and the first and second rolling elements, and rotationally connected to the thrust plate, whereby rotation of the ring collar rotates the thrust plate relative to the first and second roller cages from the first position with the first stack height, wherein the first roller elements contact the first axial surface of the thrust plate and the second roller elements contact the second axial surface of the thrust plate, to the second position, wherein the first and second rolling elements are located in the axial penetrations in the thrust plate and thus establish the second stack height.

* * * * *